US008118106B2

(12) United States Patent
Wiens et al.

(10) Patent No.: US 8,118,106 B2
(45) Date of Patent: Feb. 21, 2012

(54) FLOWBACK TOOL

(75) Inventors: Jimmy Duane Wiens, Willis, TX (US); Joseph Ross Rials, Tomball, TX (US); Raleigh Fisher, Houston, TX (US); Eric T. Johnson, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/401,802

(22) Filed: Mar. 11, 2009

(65) Prior Publication Data

US 2009/0229837 A1 Sep. 17, 2009

Related U.S. Application Data

(60) Provisional application No. 61/068,892, filed on Mar. 11, 2008.

(51) Int. Cl.
*E21B 19/18* (2006.01)

(52) U.S. Cl. ..... 166/381; 166/77.51

(58) Field of Classification Search ..... 166/381, 166/90.1, 77.1, 77.51, 85.1
See application file for complete search history.

(56) References Cited

U.S. PATENT DOCUMENTS

| | | | | |
|---|---|---|---|---|
| 1,367,156 | A | 2/1921 | McAlvay et al. | |
| 1,822,444 | A | 9/1931 | MacClatchie | |
| 2,170,057 | A * | 8/1939 | Kerr | 166/85.1 |
| 3,147,992 | A | 9/1964 | Haeber et al. | |
| 3,171,489 | A * | 3/1965 | Cole et al. | 166/368 |
| 3,698,426 | A | 10/1972 | Litchfield et al. | |
| 3,888,318 | A | 6/1975 | Brown | |
| 4,364,407 | A | 12/1982 | Hilliard | |
| 4,377,179 | A | 3/1983 | Giebeler | |
| 4,478,244 | A | 10/1984 | Garrett | |
| 4,621,403 | A * | 11/1986 | Babb et al. | 29/433 |
| 4,655,302 | A * | 4/1987 | McCreadie et al. | 175/218 |
| 4,762,187 | A | 8/1988 | Haney | |
| 4,776,617 | A | 10/1988 | Sato | |
| 4,779,688 | A | 10/1988 | Baugh | |
| 4,832,552 | A * | 5/1989 | Skelly | 414/22.54 |

(Continued)

FOREIGN PATENT DOCUMENTS

EP 1019614 B1 7/2006

(Continued)

OTHER PUBLICATIONS

PCT Search Report from Application No. PCT/US2009/036830 dated May 11, 2009.

(Continued)

*Primary Examiner* — William P Neuder
(74) *Attorney, Agent, or Firm* — Patterson & Sheridan, L.L.P.

(57) ABSTRACT

In one embodiment, a flowback tool for running a tubular string into a wellbore includes a tubular housing having a bore therethrough and a tubular mandrel. The mandrel: has a bore therethrough in communication with the housing bore, is longitudinally movable relative to the housing, is torsionally coupled to the housing, and has a threaded coupling for engaging a threaded coupling of the tubular string. The flowback tool further includes a nose: longitudinally coupled to the housing, operable to receive an end of the tubular string, and including a seal operable to engage a surface of the tubular string, thereby providing fluid communication between a bore of the tubular string and the mandrel bore. The flowback tool further includes an actuator operable to move the mandrel and the nose longitudinally relative to the housing for engaging and disengaging the tubular string.

21 Claims, 13 Drawing Sheets

U.S. PATENT DOCUMENTS

| | | | | |
|---|---|---|---|---|
| 4,867,236 | A | 9/1989 | Haney et al. | |
| 4,955,949 | A | 9/1990 | Bailey et al. | |
| 4,962,819 | A | 10/1990 | Bailey et al. | |
| 4,997,042 | A | 3/1991 | Jordan et al. | |
| 5,036,927 | A | 8/1991 | Willis | |
| 5,152,554 | A | 10/1992 | LaFleur et al. | |
| 5,172,940 | A | 12/1992 | Usui et al. | |
| 5,191,939 | A | 3/1993 | Stokley | |
| 5,282,653 | A | 2/1994 | LaFleur et al. | |
| 5,297,833 | A | 3/1994 | Willis et al. | |
| 5,348,351 | A | 9/1994 | LaFleur et al. | |
| 5,441,310 | A | 8/1995 | Barrett et al. | |
| 5,479,988 | A | 1/1996 | Appleton | |
| 5,501,280 | A | 3/1996 | Brisco | |
| 5,509,442 | A | 4/1996 | Claycomb | |
| 5,577,566 | A | 11/1996 | Albright et al. | |
| 5,584,343 | A | 12/1996 | Coone | |
| 5,645,131 | A | 7/1997 | Trevisani | |
| 5,682,952 | A | 11/1997 | Stokley | |
| 5,735,348 | A | 4/1998 | Hawkins, III | |
| 5,836,395 | A | 11/1998 | Budde | |
| 5,918,673 | A | 7/1999 | Hawkins et al. | |
| 5,971,079 | A | 10/1999 | Mullins | |
| 5,992,520 | A | 11/1999 | Schultz et al. | |
| 6,053,191 | A | 4/2000 | Hussey | |
| 6,102,116 | A | 8/2000 | Giovanni | |
| 6,173,777 | B1 | 1/2001 | Mullins | |
| 6,279,654 | B1 | 8/2001 | Mosing et al. | |
| 6,390,190 | B2 | 5/2002 | Mullins | |
| 6,460,620 | B1 * | 10/2002 | LaFleur | 166/324 |
| 6,571,876 | B2 | 6/2003 | Szarka | |
| 6,578,632 | B2 | 6/2003 | Mullins | |
| 6,732,819 | B2 | 5/2004 | Wenzel | |
| 6,779,599 | B2 | 8/2004 | Mullins et al. | |
| 6,832,656 | B2 | 12/2004 | Fournier, Jr. et al. | |
| 6,883,605 | B2 | 4/2005 | Arceneaux et al. | |
| 7,007,753 | B2 | 3/2006 | Robichaux et al. | |
| 7,017,671 | B2 | 3/2006 | Williford | |
| 7,147,254 | B2 | 12/2006 | Niven et al. | |
| 7,370,707 | B2 * | 5/2008 | McDaniel et al. | 166/380 |
| 7,490,677 | B2 | 2/2009 | Buytaert et al. | |
| 7,694,744 | B2 | 4/2010 | Shahin | |
| 2001/0011589 | A1 * | 8/2001 | Mullins | 166/90.1 |
| 2006/0000600 | A1 * | 1/2006 | Pietras | 166/77.52 |
| 2006/0278402 | A1 | 12/2006 | Mullins | |
| 2007/0140801 | A1 * | 6/2007 | Kuttel et al. | 408/129 |
| 2007/0181346 | A1 | 8/2007 | Swietlik et al. | |
| 2009/0205827 | A1 | 8/2009 | Swietlik et al. | |
| 2009/0205836 | A1 | 8/2009 | Swietlik et al. | |
| 2009/0205837 | A1 | 8/2009 | Swietlik et al. | |
| 2009/0266532 | A1 | 10/2009 | Revheim et al. | |

FOREIGN PATENT DOCUMENTS

| | | | |
|---|---|---|---|
| GB | 2435059 | B | 5/2008 |
| WO | WO-9307358 | | 4/1993 |
| WO | WO-9607009 | A2 | 3/1996 |
| WO | WO-2007108703 | A1 | 9/2007 |
| WO | WO-2007144597 | A1 | 12/2007 |

OTHER PUBLICATIONS

"Circulating/flowback tool cuts surge pressure," Drilling Contractor, Mar./Apr. 2001, pp. 30-31.

Petronov—Brochures for FCH Models C, L, and S, 15 pages. (Date Unknown).

PCT Written Opinion and Search Report dated May 11, 2009, International Application No. PCT/US2009/036830.

* cited by examiner

FLOWBACK TOOL

CROSS-REFERENCE TO RELATED APPLICATIONS

This application claims benefit of U.S. Provisional Pat. App. No. 61/068,892, filed Mar. 11, 2008, which is hereby incorporated by reference in its entirety.

BACKGROUND OF THE INVENTION

In wellbore construction and completion operations, a wellbore is initially formed to access hydrocarbon-bearing formations (i.e., crude oil and/or natural gas) by the use of drilling. Drilling is accomplished by utilizing a drill bit that is mounted on the end of a tubular string, commonly known as a drill string. To drill within the wellbore to a predetermined depth, the drill string is often rotated by a top drive or rotary table and Kelly on a surface platform or rig, and/or by a downhole motor mounted towards the lower end of the drill string. A pumping system is used to inject drilling fluid through the top drive or Kelly, down the drill string, through the rotating drill bit, and back to the surface via an annulus formed between the borehole wall and the drill bit. As the drilling fluid exits the bit, the fluid carries cuttings from the bit and the drilling fluid and cuttings are typically referred to as returns. Typically, the drilling fluid is a mud including a base fluid, typically water or oil, and various additives suspended, dissolved, and/or emulsified in the base fluid.

After drilling to a predetermined depth, the drill string and drill bit are removed and another tubular string of casing (or liner) is lowered into the wellbore. An annulus is thus formed between the string of casing and the formation. The casing string is temporarily hung from the surface of the well. A cementing operation is then conducted in order to fill the annular area with cement. The casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

A drilling rig is constructed on the earth's surface to facilitate the insertion and removal of tubular strings (i.e., drill strings or casing strings) into a wellbore. Alternatively, the drilling rig may be disposed on a jack-up platform, semi-submersible platform, or a drillship for drilling a subsea wellbore. The drilling rig includes a platform and power tools, such as a top drive, power tongs, and a spider, to engage, assemble, and lower the tubulars into the wellbore.

In order to drill and case the wellbore, it is necessary deploy tubular strings into the wellbore and may be necessary to remove tubular strings from the wellbore. Further intervention operations, such as fishing a broken or stuck tubular or tool, and workover operations also require deploying and removing tubular strings. When tubular strings are being run into or pulled from the wellbore, it is often necessary to fill the tubular string, take returns from the tubular string, or circulate fluid through the tubular string. This requires that the tubular string be threaded to the top drive (or Kelly hose) or be connected a circulation head. Previous circulation heads are firmly attached to the traveling block or top drive. In either case, precise spacing is required of the seal assembly relative to the tubular and elevators. In the case where slip-type elevators are used, the spacing of the seal could be such that when the elevators were near the upset of the tubular, the seal could be out of the tubular. When required, the slips at the rig floor must be set on the tubular and the traveling block or top drive lowered in order to move the seal into sealing engagement with the tubular. This requires that the running or pulling of the tubular stop until the slips were set at the rig floor and the seal engagement be made. This is not desirable when a well kick occurs or fluid is overflowing from the tubular.

In the case where "side door" or latching elevators are used, the seal must be engaged in the tubular prior to latching the elevators below the upset portion of the tubular. This requires that the seal be engaged in the tubular at all times that the elevators are latched on the tubular. When joints or stands of tubulars are racked back in the derrick, it is difficult to insert the seal into the tubular prior to latching the elevators with the top of the tubular far above the derrick man. Also, with the seal engaged in the tubular at all times, this is a disadvantage when there is a need to access the top of the tubular while the tubulars are in the elevators or when the tubular is being filled with fluid and the air in the tubular begins to be entrained in the fluid column rather than escaping the tubular. For example, if a high-pressure line was to be attached to the tubular and the tubular moved at the same time, all previous devices had to be "laid down" to allow a hard connection to be made to the tubular since they are in the way of the tubular connection.

Mudsaver valves are usually connected to the lower end of the top drive/Kelly or circulation head to prevent spillage of mud when the top drive/Kelly hose or circulation head are disconnected from the tubular. The use of a mudsaver valve is desirable to prevent the loss of mud, to prevent unsafe operating conditions for personnel, and to minimize contamination of the environment.

SUMMARY OF THE INVENTION

In one embodiment, a flowback tool for running a tubular string into a wellbore includes a tubular housing having a bore therethrough and a tubular mandrel. The mandrel: has a bore therethrough in communication with the housing bore, is longitudinally movable relative to the housing, is torsionally coupled to the housing, and has a threaded coupling for engaging a threaded coupling of the tubular string. The flowback tool further includes a nose: longitudinally coupled to the mandrel, operable to receive an end of the tubular string, and including a seal operable to engage a surface of the tubular string, thereby providing fluid communication between a bore of the tubular string and the mandrel bore. The flowback tool further includes an actuator operable to move the mandrel and the nose longitudinally relative to the housing for engaging and disengaging the tubular string.

In another embodiment, a method for running a tubular string into a wellbore includes engaging a tubular string with an elevator and operating an actuator of a flowback tool in fluid communication with a Kelly hose. Operation of the actuator: lowers a nose of the flowback tool to an end of the tubular string relative to a housing of the flowback tool, engages a seal of the nose with a surface of the tubular string, and provides fluid communication between a bore of the tubular string and the Kelly hose. The housing is longitudinally coupled to a traveling block of a drilling rig and the mandrel is torsionally coupled to the housing and has a threaded coupling for engaging a threaded coupling of the tubular string. The method further includes lowering the tubular string into the wellbore using the elevator.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
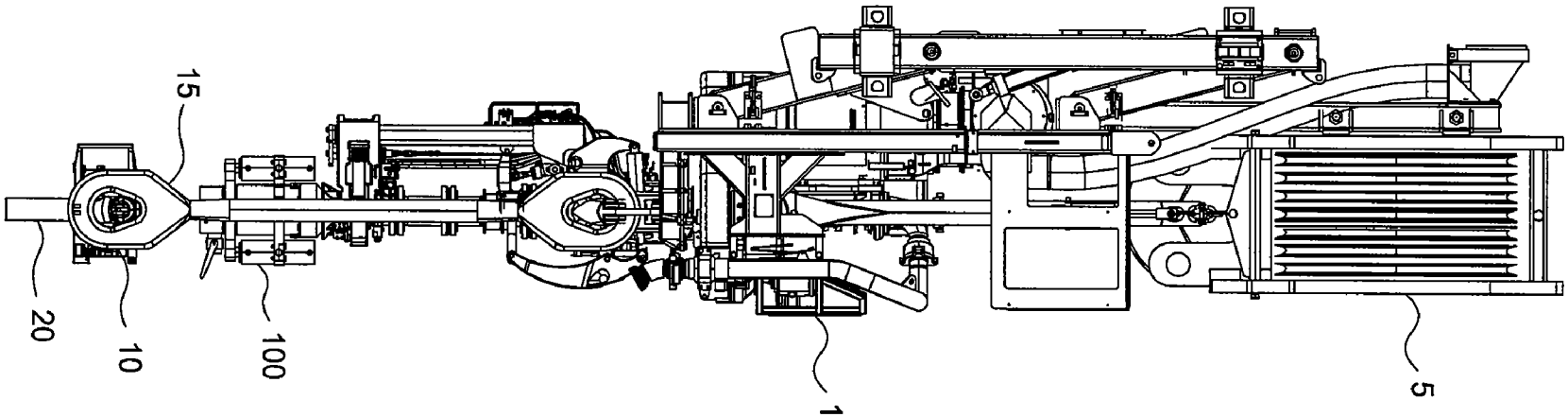
FIG. 1 illustrates a flowback tool assembled with a top drive, according to one embodiment of the present invention.

FIG. 1 illustrates a flowback tool 100 assembled with a top drive 1, according to one embodiment of the present invention. The top drive 1 may include a non-rotating frame, a motor, a Kelly hose connection, a hydraulic swivel, and a backup tong. The top drive 1 may be hoisted from the drilling rig by a traveling block 5. The frame of the top drive may receive a hook of the traveling block, thereby longitudinally coupling the frame to the traveling block 5. The top drive motor may be electric or hydraulic. The frame may be torsionally coupled to a rail (not shown) of the rig so that the top drive 1 may longitudinally move relative to the rail. The hydraulic swivel may provide fluid communication between the non-rotating Kelly hose connection and a rotating quill of the motor for injection of drilling fluid from the rig mud pumps (not shown) through the top drive 1. The hydraulic swivel may also connect to the traveling block 5 for transferring weight of the top drive from the rotating quill to the non-rotating traveling bock. The manifold may connect hydraulic, electrical, and/or pneumatic conduits from the rig floor to the top drive 1. The manifold may be longitudinally and torsionally coupled to the frame.

An elevator 10 may be longitudinally and torsionally coupled to the top drive frame via bails 15. The elevator 10 may include a gripper, such as slips and a cone, for grabbing and hoisting a tubular joint or stand 20, such as drill pipe (shown) or casing. The elevator and the top drive may deliver the joint/stand 20 to a tubular string 20 where the joint/stand may be made up with the tubular string. The flowback tool 100 may be longitudinally and torsionally connected to a quill of the top drive, such as by a threaded connection.

Figure 1A:
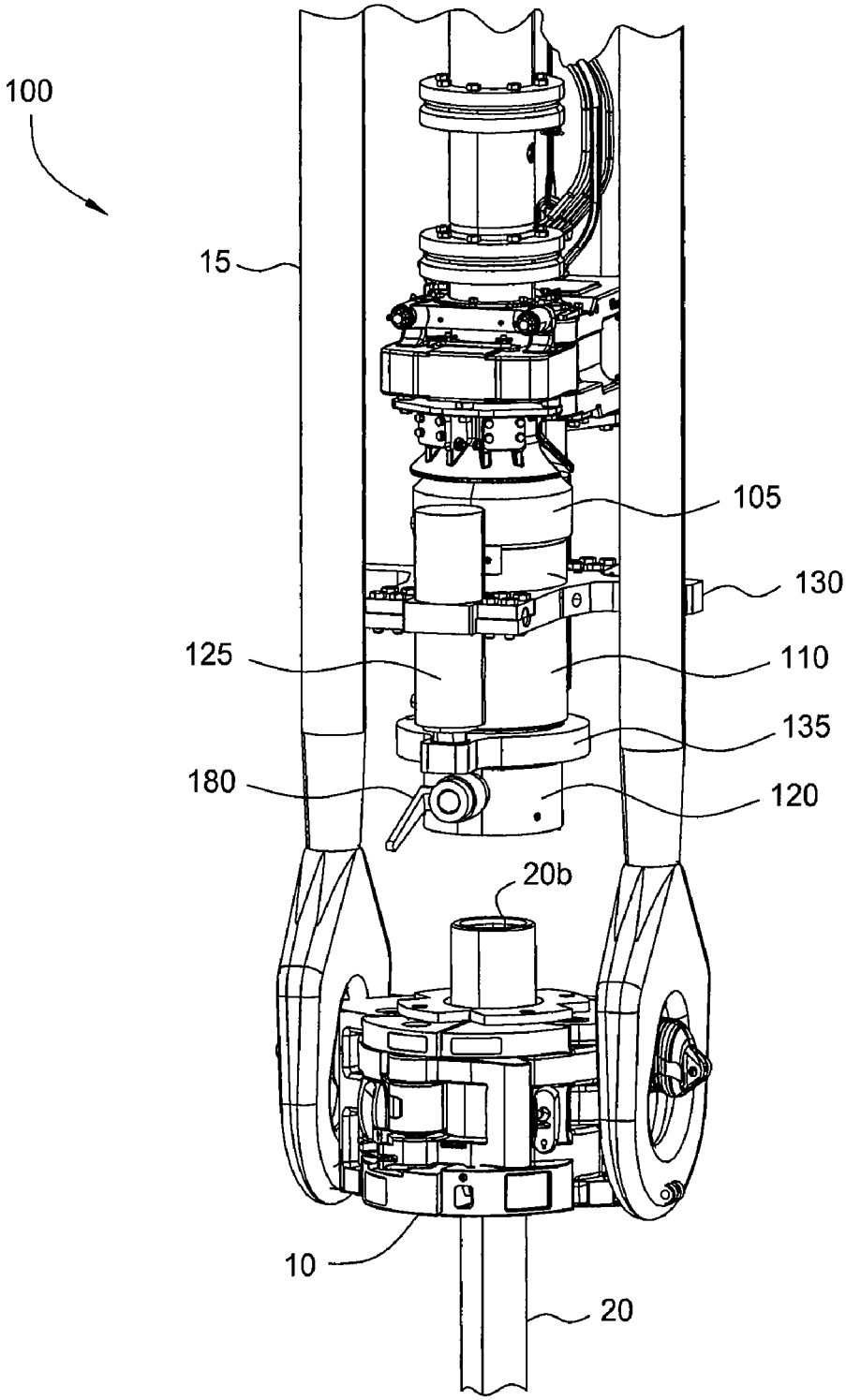
FIG. 1A illustrates the flowback tool in a retracted position.
Figure 1B:
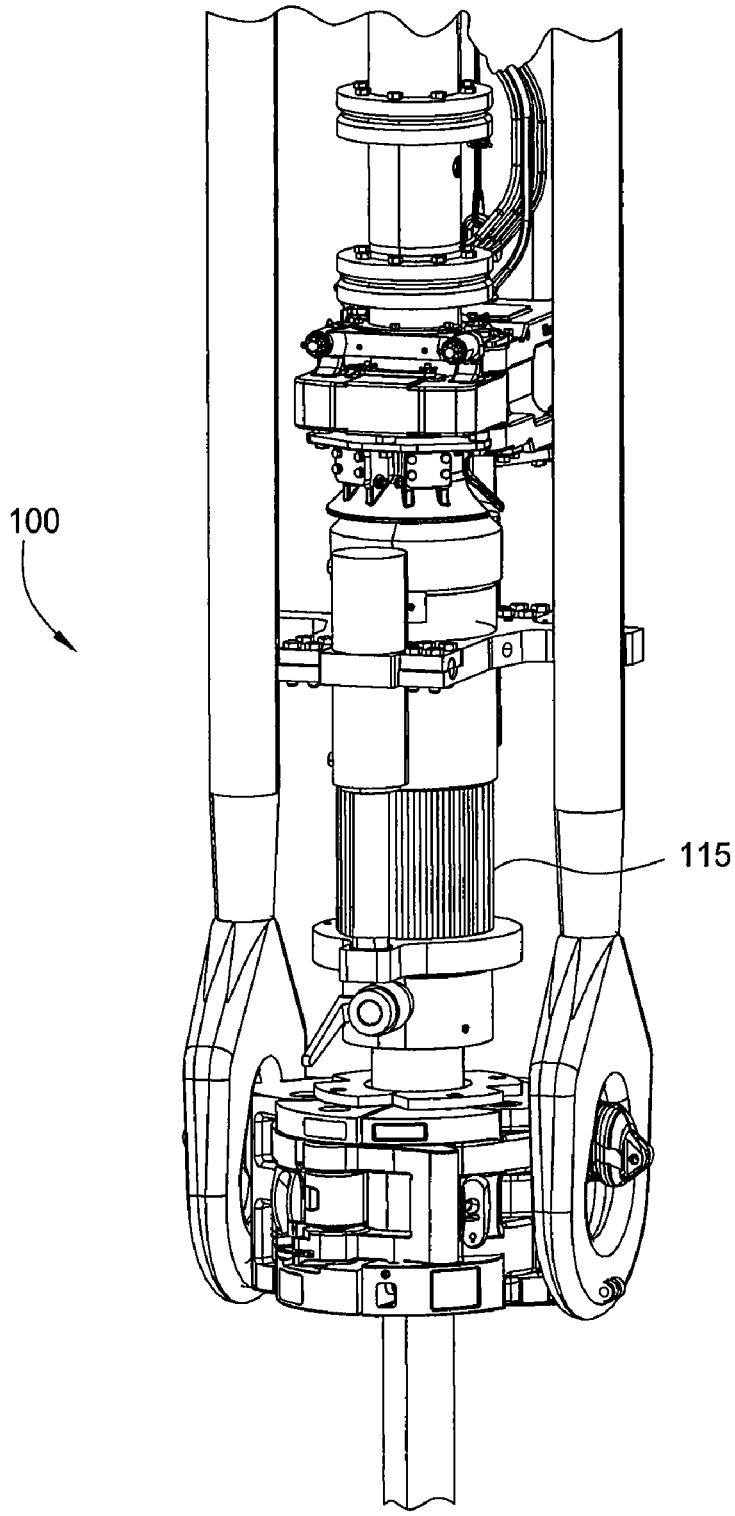
FIG. 1B illustrates the flowback tool in an engaged position.

FIG. 1A illustrates the flowback tool 100 in a retracted position. FIG. 1B illustrates the flowback tool 100 in an engaged position. Except for seals, components of the flowback tool 100 may be made from a metal or alloy. Seals of the flowback tool 100 may be made from a polymer, such as an elastomer. The flowback tool 100 may include a cap 105, a housing 110, a mandrel 115, a nose 120, and an actuator. The mandrel 115 and the nose 120 may be longitudinally movable relative to the housing 110 between the retracted position and the engaged position by the actuator. The nose 120 may sealingly engage an outer surface of the tubular 20 in the engaged position, thereby providing fluid communication between the top drive 1 and the bore of the tubular 20.

The actuator may include two or more piston and cylinder assemblies (PCAs) 125, a first swivel 130, and a second swivel 135. Each PCA 125 may be longitudinally coupled to the housing 110 via the first swivel 130 and longitudinally coupled to the nose 120 via the second swivel 135. The swivel 130 may include arms for engaging the bails 15, thereby torsionally coupling the PCAs 125 to the bails 15. Each of the swivels 130, 135 may include one or more bearings, thereby allowing relative rotation between the PCAs 125 and the housing 110. Hydraulic conduits (not shown), such as hoses, may extend from each of the PCAs 125 to the top drive manifold or a separate hydraulic pump added to the top drive frame to provide for extension and retraction of the PCAs. As discussed below, a hydraulic conduit may also extend to the swivel 135 which may be in fluid communication with the nose 120 via port 135*p*.

Figure 2:
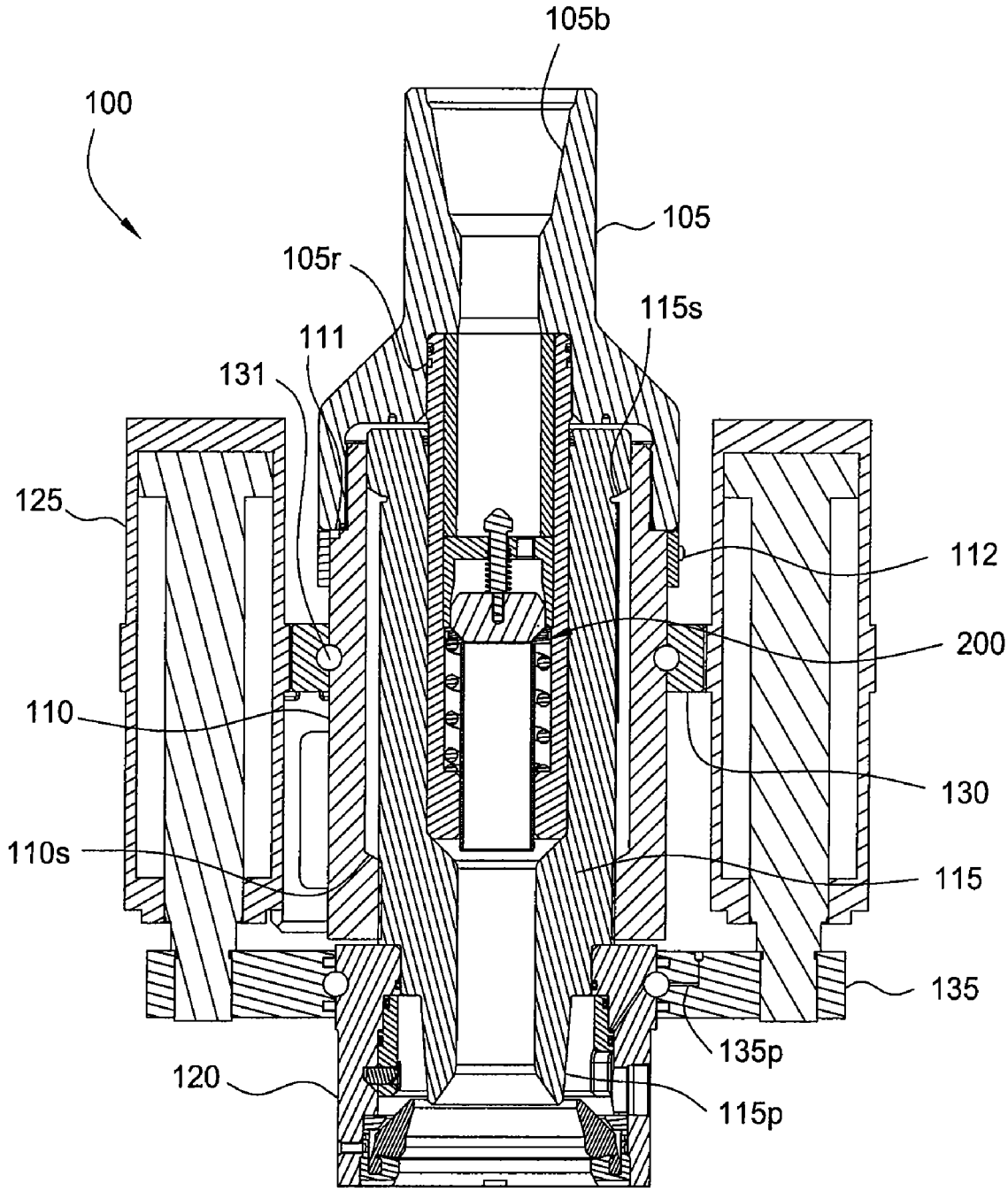
FIG. 2 is a cross section of the flowback tool in a retracted position.

FIG. 2 is a cross section of the flowback tool 100 in a retracted position. The cap 105 may be annular and have a bore therethrough. A first longitudinal end of the cap 105 may include a threaded coupling, such as a box 105*b*, for connection with a threaded coupling of the quill, such as a pin, thereby longitudinally and torsionally coupling the quill and the cap 105. One or intermediate subs (not shown), such as a thread saver crossover, and/or well control valve, may connect between the quill and the cap. The cap 105 may taper outwardly so that a second longitudinal end may have a substantially greater diameter than the first longitudinal end. An inner surface of the second longitudinal end of the cap 105 may be threaded for receiving a threaded first longitudinal end of the housing 110, thereby longitudinally coupling the cap and the housing. The second longitudinal end of the cap 105 and the first longitudinal end of the housing 110 may include one or more keyways formed therein. A key 111 may be disposed in each keyway, thereby torsionally coupling the housing and the cap. A retainer plate 112 may be fastened to the housing 110 or the cap 105 for retaining each of the keys 111.

The housing 110 may be tubular and have a bore formed therethrough. An outer surface of the housing 110 may be grooved for receiving the bearings, such as ball bearings 131, thereby longitudinally coupling the housing and the swivel 130. A second longitudinal end of the housing 110 may be longitudinally splined for engaging longitudinal splines formed on an outer surface of the mandrel 115, thereby torsionally coupling the housing 110 and the mandrel 115. The second longitudinal end of the housing 110 may form a shoulder 110*s* for receiving a corresponding shoulder 115*s* formed at a first longitudinal end of the mandrel 115, thereby longitudinally coupling the housing 110 and the mandrel 115. The PCAs 125 may be capable of supporting weight of the nose 120 and the mandrel 115 and the shoulders 110*s*, 115*s*, when engaged, may be capable of supporting weight of the tubular string 20. The shoulders 110*s*, 115*s* may engage before the PCAs 125 bottom out, thereby ensuring that string weight is not transferred to the PCAs.

A second longitudinal end of the mandrel 115 may form a threaded coupling, such as a pin 115*p*, for engaging a threaded coupling, such as a box 20*b*, formed at a first longitudinal end of the tubular 20. An outer surface of the mandrel 115 near the second longitudinal end may be threaded and form a shoulder for receiving a threaded inner surface and shoulder of the nose 120, thereby longitudinally and torsionally coupling the nose 120 and the mandrel 115. One or more seals, such as O-rings, may be disposed between the mandrel 115 and the nose 120, thereby isolating a seal chamber of the nose 120 (discussed below) from an exterior of the flowback tool 100. A substantial portion of the mandrel bore may be sized to receive a body 205 of a mudsaver valve (MSV) 200. One or more seals, such as O-rings, may be disposed between the body 205 and the mandrel 115 (on mandrel as shown), thereby isolating the first longitudinal end of the mandrel 115 from the housing bore. Isolating the first longitudinal end of the mandrel 115 may prevent the mandrel end from acting as a piston and longitudinally exerting a downward force on the mandrel 115 and the nose 120.

Figure 2A:
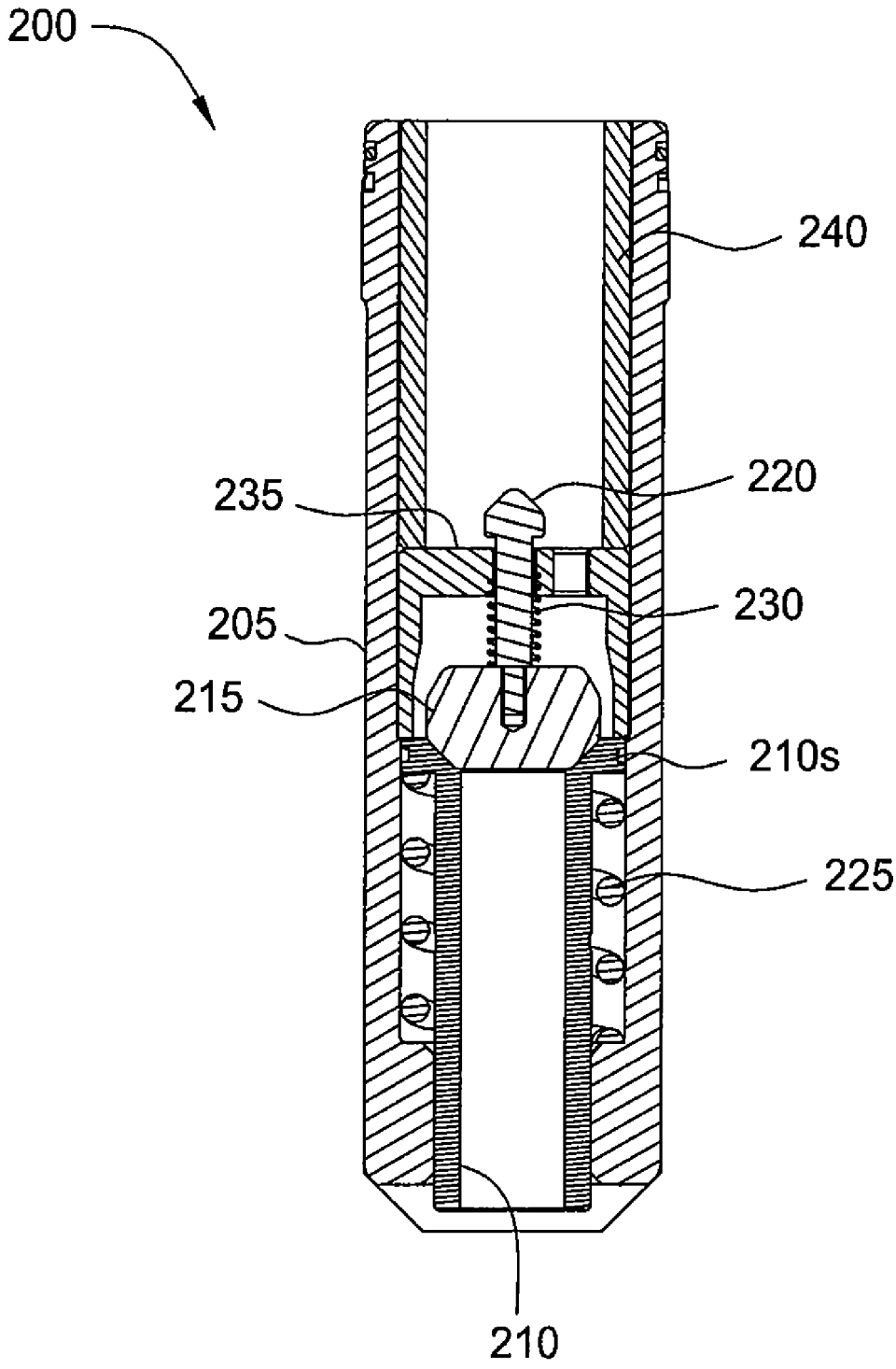
FIG. 2A is a cross section of the mudsaver valve of the flowback tool in a closed position.

FIG. 2A is a cross section of the MSV 200 of the flowback tool 100 in a closed position. The flowback tool 100 may further include the MSV 200. The MSV 200 may include the body 205, a seat 210, a poppet 215, a stem 220, a seat spring 225, a poppet spring 230, a baffle 235, and a sleeve 240. The body 205 may be tubular and have a bore formed therethrough. A first longitudinal end of the body 205 may be received in a recess 105*r* formed in the cap 105. The cap recess 105*r* may include a shoulder and the body 205 may abut the shoulder. The cap 105 may include one or more holes formed through a wall thereof for receiving respective fasteners, such as set screws, thereby longitudinally coupling the body 205 and the cap 105. One or more seals, such as O-rings, may be disposed between the body 205 and the cap 105 and, along with the seal between the body 205 and the mandrel 115, thereby isolating the body bore from the housing bore.

The body 205 may include a first shoulder formed second shoulder formed between the longitudinal ends thereof and a second shoulder formed at a second longitudinal end thereof. The seat spring 225 may be disposed longitudinally against the second shoulder. The seat 210 may be tubular and include a shoulder 210*s* formed at a first longitudinal end and engaging the seat spring 225, thereby longitudinally biasing the seat toward the poppet 215. A seal, such as an O-ring, may be disposed between the seat shoulder 210*s* and the body 205, thereby isolating a first face of the seat shoulder 210*s* from a second face of the seat shoulder. The second face of the seat shoulder 210*s* and the spring chamber may be in fluid communication with the mandrel bore via leakage between a second longitudinal end of the seat 210 and the body 205 (no seal).

The baffle 235 may be annular and have a recess formed therein partially enclosed by a first longitudinal end thereof. The first longitudinal end may include a central bore and one or more eccentric flow ports formed longitudinally therethrough. The baffle bore may receive the stem 220. A second longitudinal end of the baffle 235 may abut the body second shoulder and the seat shoulder 210*s* (in the closed position). The stem 220 may be a rod and have a conical first end for minimizing flow disruption and a threaded second end received by a threaded opening formed in the poppet 215, thereby longitudinally coupling the stem 220 and the poppet 215. The poppet spring 230 may be disposed along the stem 220 and abut the baffle 235 and the poppet 215, thereby longitudinally biasing the poppet 215 toward the seat 210.

The poppet 215 may have a first longitudinal flat face for receiving the stem 220 and the poppet spring 230 and a dual tapering outer surface. The first taper in the poppet outer surface may minimize flow disruption and a second taper in the poppet outer surface may mate with a taper formed in an inner surface of the seat 210. The mating tapered surfaces may have a smooth finish for metal-to-metal sealing engagement. The poppet 215 may further have a second longitudinal flat face for receiving fluid pressure. An inner diameter of the baffle recess may be greater than a maximum outer diameter of the poppet 215 to define a flow path therebetween. The sleeve 240 may be tubular and have a bore formed therethrough. A first longitudinal end of the sleeve 240 may abut the cap shoulder and a second longitudinal end of the sleeve 240 may abut the first longitudinal end of the baffle 235, thereby longitudinally coupling the baffle 235 and the cap 105.

The sleeve 240, baffle 235, poppet 215, stem 230, and seat 210 may be hardened, such as by case hardening, or made from a hard metal or alloy, to resist erosion. A stiffness of the seat spring 210 may be selected to exert a closing force greater than or equal to an opening force exerted by hydrostatic pressure of drilling fluid contained in the top drive 1, thereby preventing spillage of the drilling fluid when the flowback tool 100 is disengaged from the tubular 20. A stiffness of the seat spring 210 may also be selected such that the closing force is substantially less than an opening force exerted by discharge pressure of the rig mud pump so that the seat 210 moves longitudinally away from the poppet 215 upon activation of the mud pump (due to the shoulder 210*s* acting as a piston). A stiffness of the poppet spring 230 may be selected to maintain tight sealing engagement between the poppet 215 and the seat 210 and may be less or substantially less than a stiffness of the seat spring 210.

Figure 2B:
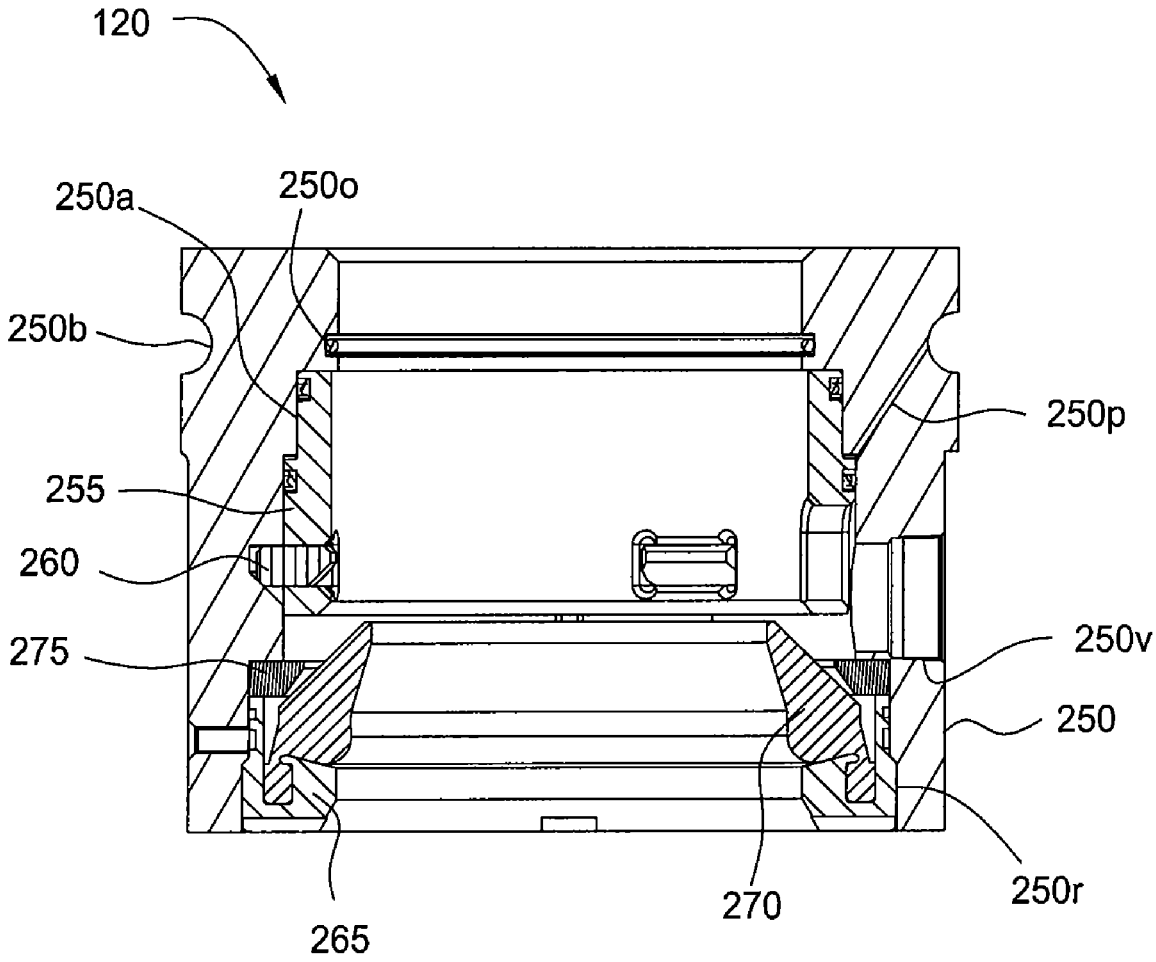
FIG. 2B is a cross section of a nose of the flowback tool in an unlocked position.

FIG. 2B is a cross section of a nose 120 of the flowback tool 100 in an unlocked position. The nose 120 may include a body 250, a piston 255, one or more locks, such as dogs 260, a seal retainer 265, a seal 270, a stop 275, and a valve 180. The body 250 may be annular and have a bore therethrough. The body 250 may include a groove 250*b* formed in an outer surface for receiving the ball bearings 131. A port 250*p* may be formed through the wall of the housing 250 providing fluid communication between the groove 250*b* and an outer surface of the piston 255. The body 250 may include one or more slots 250*s* formed in an inner surface for receiving respective dogs 260. Each slot 250*s* may have an inclined face for radially moving the dogs 260 from a retracted position to an extended position as the piston 255 moves longitudinally relative to the body 250.

The piston 255 may include corresponding slots formed therethrough for receiving the dogs 260. Each piston slot may include a lip (not shown) for abutting a respective lip (not shown) formed in each dog, thereby radially retaining the dogs in the slot. Each dog 260 may include a tapered inner surface for engaging an end of the tubular 20 when the tubular is being moved longitudinally relative to the body 250 from the locked position to the well control position, thereby longitudinally moving the piston 255 and radially moving the dogs 260 from the extended position to the retracted position. The body 250 may include a groove 250*o* formed in an inner surface for receiving a seal, such as an o-ring, for engagement with the mandrel 115 (discussed above). The body 250 may include a keyway (not shown) and the outer surface of the piston 255 may have a key (not shown) formed therein (or vice versa) for ensuring and maintaining torsional alignment of the piston 255 and the body 250.

The body 250 may include a vent 250*v* formed through a wall thereof and in fluid communication with a seal chamber, defined by a portion of the nose bore between the seal 270 and the mandrel seal, and the valve 180 for safely disposing of residual fluid left in the seal chamber before disengaging the tubular 20. The vent 250*v* may be threaded for receiving a threaded coupling of the valve 180, thereby longitudinally and torsionally coupling the valve and the body 250. The body 250 may include a recess 250*r* formed at a second longitudinal end thereof for receiving the seal retainer 265 and the stop 275. One or more holes may be formed through the housing wall for receiving fasteners, such as set screws, thereby longitudinally coupling the seal retainer 265 and the body 250. The body 250 may include a profile 250*a* formed therein for receiving a corresponding profile formed in an outer surface of the piston 255.

The piston 255 may be annular and have a bore formed therethrough. The piston 255 may be disposed in the body 250 and longitudinally movable relative thereto between a locked position (FIG. 3A) and the unlocked position. The piston may include the profile on the outer surface thereof. Upper and lower seals, such as o-rings, may be disposed between the piston 255 and the body 250 (on piston as shown) so as to straddle the port 250*p*, thereby isolating a piston chamber from the remainder of the nose 120. A shoulder may be formed as part of the piston profile, thereby providing a piston surface. The piston 255 may have a port formed therethrough in alignment with the vent 250*v* when the piston is in the locked position and partially aligned with the vent when the piston is in the unlocked position. The piston 255 may abut the stop 275 in the locked position.

The seal retainer 265 may be annular and may have a substantially J-shaped cross section for receiving and retaining the seal 270. The seal 270 may include a base portion having a lip for engaging a corresponding lip of the retainer 265 and a cup portion for engaging the outer surface of the tubular 20. An outer surface of the cup portion may be inclined for receiving fluid pressure to press the cup portion into engagement with the tubular 20. When engaged, the cup portion may be supported by a tapered inner surface of the stop 275 and/or the piston 255. The seal 270 may be molded into the retainer 265 or pressed therein. The stop 275 may abut a shoulder of the recess 250*r* and a first longitudinal end of the retainer 265, thereby longitudinally coupling the stop 275 and the body 250.

Alternatively, the nose 120 and seal 270 may be arranged so that the seal 270 engages an inner surface of the tubular 20. This alternative may be accomplished simply by removing the seal retainer 265 (and seal 270) from the nose 120 and replacing the seal retainer 265 with an alternative seal retainer (not shown) configured to extend into the tubular string 20 with a seal configured to engage an inner surface of the tubular string 20. The seal 270 engaging the outer surface may be more suitable when the tubular string 20 is smaller drill pipe and the seal engaging the inner surface of the tubular string 20 may be more suitable when the tubular string 20 is larger casing.

The nose 120 and/or the second longitudinal end of the mandrel 115 may be configured so that the nose and the mandrel are biased away (i.e., upward) from the tubular string 20 in the engaged position (FIG. 3) by fluid pressure from the tubular string 20. Alternatively, the nose 120 and/or the second longitudinal end of the mandrel 115 may be configured so that the nose and the mandrel are not biased relative to the tubular string 20 in the engaged position (FIG. 3) by fluid pressure from the tubular string 20.

Figure 3:
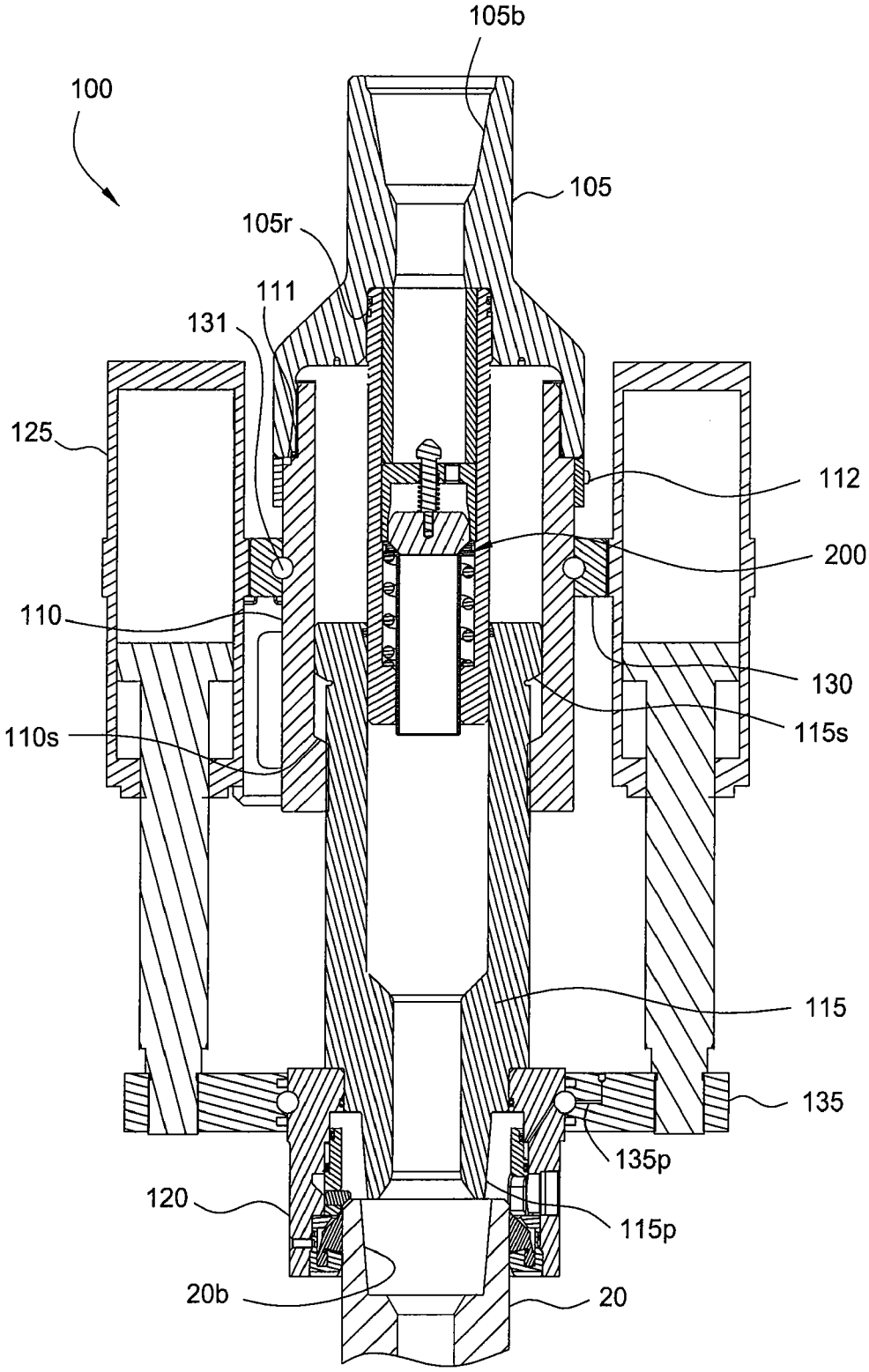
FIG. 3 is a cross section of the flowback tool in an engaged position.
Figure 3A:
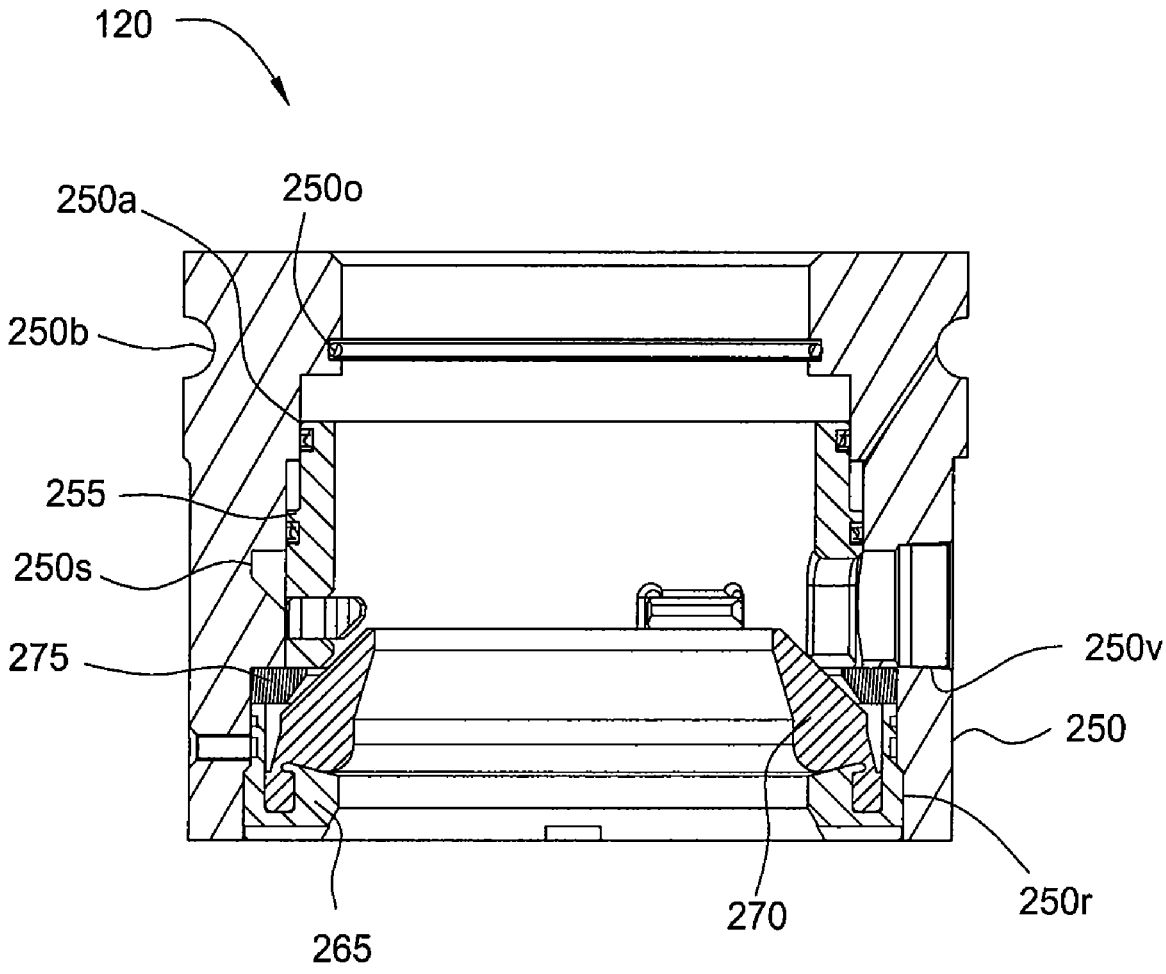
FIG. 3A is a cross section of a nose of the flowback tool in a locked position.

FIG. 3 is a cross section of the flowback tool 100 in an engaged position. FIG. 3A is a cross section of a nose 120 in a locked position. Once a joint or stand 20 is made up with the tubular string (not shown), the tubular string 20 may be ready to be advanced into the wellbore. Hydraulic fluid from the top drive manifold/hydraulic pump may be injected into the nose 120 via the second swivel 135, thereby locking the piston 255 or moving the piston 255 into the locked position and locking the piston 255. Hydraulic pressure may be maintained on the piston 255 during advancement of the tubular 20 into the wellbore, thereby rigidly locking the piston 255 and the dogs 260. Hydraulic fluid may be then injected into the PCAs 125, thereby lowering the nose 120 and the mandrel 115 until an outer surface of the box 20*b* engages the seal 270 and then the dogs 260. Hydraulic pressure may be maintained on the PCAs 125 during advancement of the tubular 20 into the wellbore, thereby overcoming the upward bias from fluid pressure, discussed above, and ensuring that the dogs 260 and seal 270 remain engaged to the tubular 20 during advancement of the tubular 20 into the wellbore. Engagement of the seal 270 with the box 20*b* may provide fluid communication between the tubular string 20 and the top drive 1, thereby allowing the joint/stand 20 to be filled with drilling fluid, circulation of drilling fluid through the tubular string 20 during advancement of the joint/stand 20 into the wellbore, and/or receiving returns displaced by advancement of the joint/stand 20 into the wellbore.

Once the joint/stand 20 has been advanced into the wellbore, the spider (not shown) may be set. The valve 180 may be connected to a disposal line (not shown) and fluid may be bled through the vent 250*v* by opening the valve 180. Hydraulic pressure to the PCAs may be reversed, thereby raising the nose and the mandrel to the retracted position. Hydraulic pressure may be relieved from the piston (although the piston may not return to the unlocked position). The elevator 10 may then release the joint/stand 20. The top drive 1 may be moved proximate to another joint/stand (not shown) and the elevator 10 operated to grab the joint/stand. The joint/stand may be moved into position over the tubular string 20, engaged with the tubular string 20, and the elevator 10 released. The joint/stand may be made up with the tubular string and the elevator 10 may engage the tubular string 20. The flowback tool 100 may then again be operated by repeating the cycle. Operation of the flowback tool 100 may be similar for removing the tubular string 20 from the wellbore.

Figure 4A:
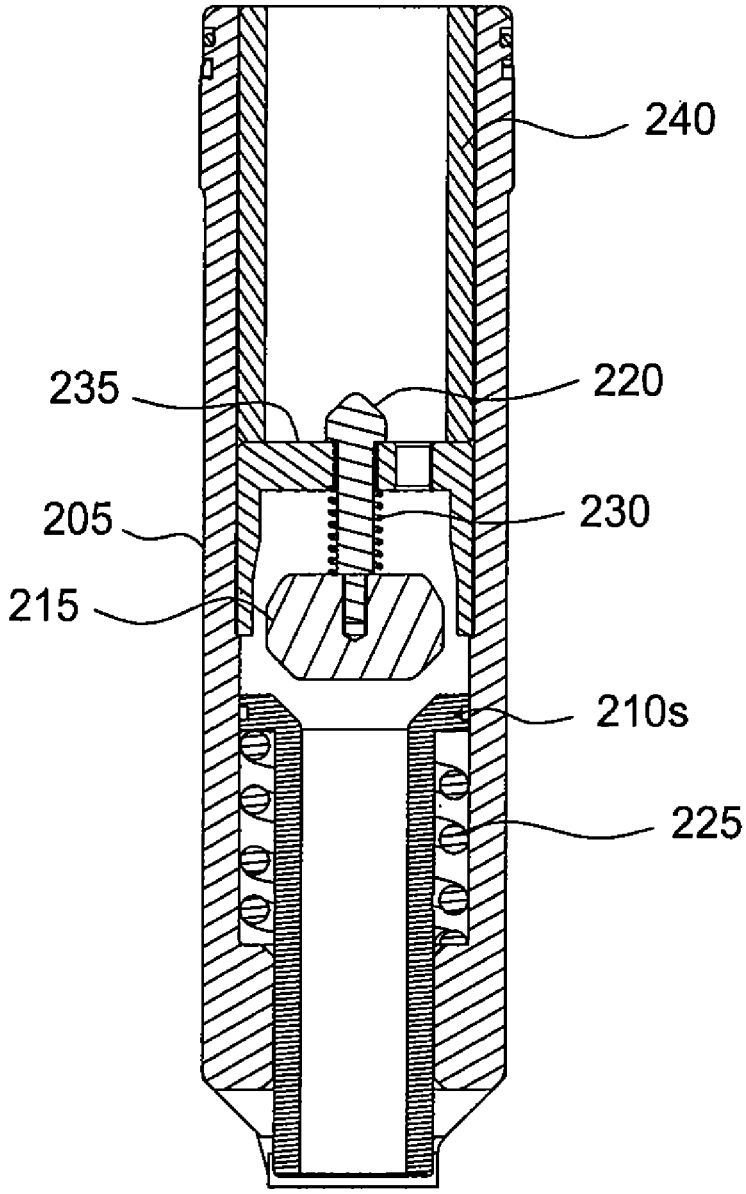
FIG. 4A is a cross section of the mudsaver valve of the flowback tool in a fill or circulation position.

FIG. 4A is a cross section of the MSV 200 in a fill or circulation position. If it desired to fill the tubular before/during advancement into the wellbore or circulate fluid through the tubular string during before/during/after advancement into the wellbore, drilling fluid from the mud pump may be injected into and through the top drive 1 via the Kelly hose. The fluid may exit the quill and enter the cap 105, flow through the cap bore, through the baffle 235, around the poppet 215, and to the seat shoulder 210*s*. Fluid pressure exerted on the seat 210 may push the seat 210 longitudinally away from the poppet 215 and against the seat spring 225, thereby compressing the seat spring 225 and creating a flow path. Fluid may exit the MSV 200, flow through the mandrel bore, and into the tubular 20.

Figure 4B:
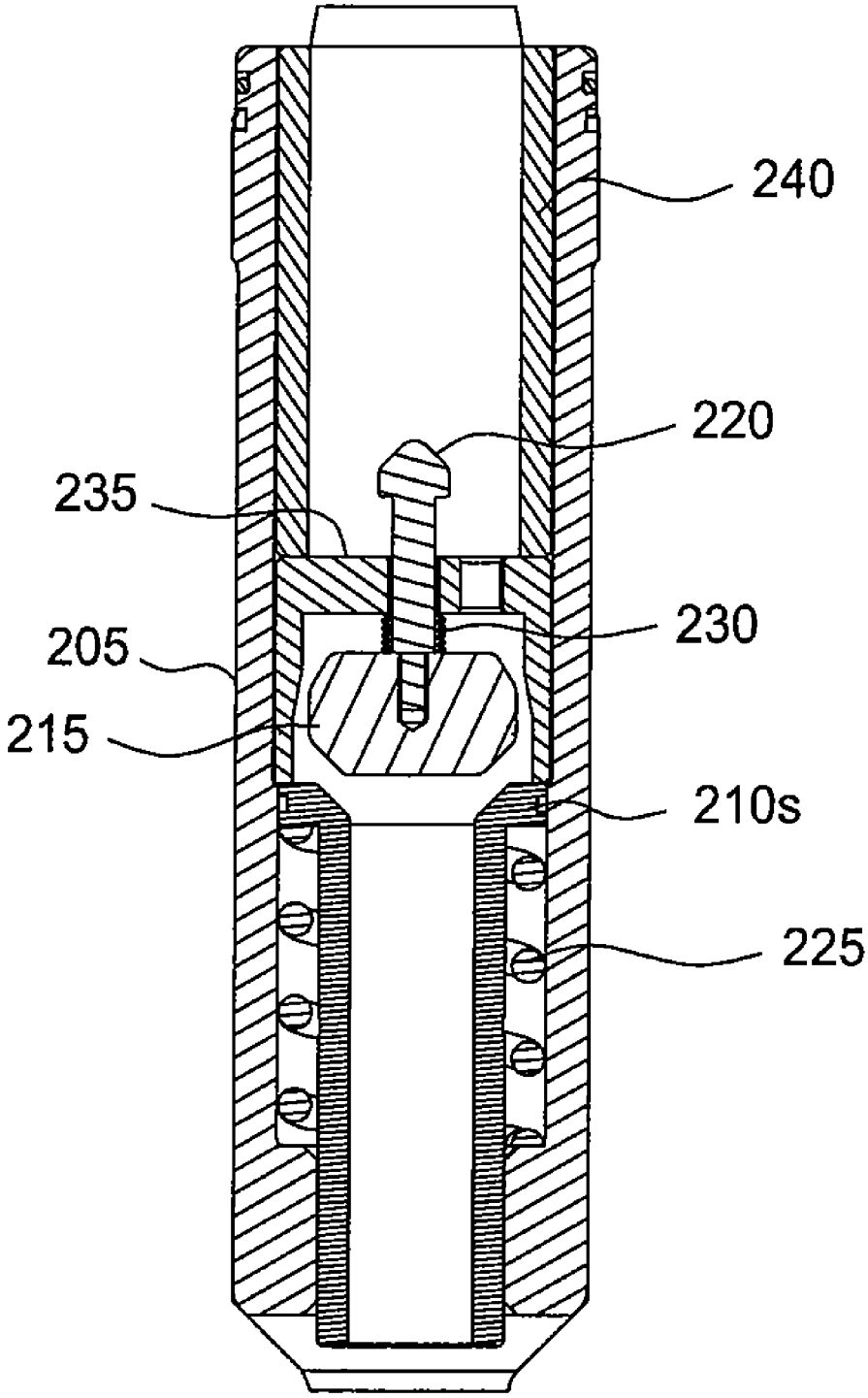
FIG. 4B is a cross section of the mudsaver valve of the flowback tool in a returns position.

FIG. 4B is a cross section of the MSV 200 in a returns position. Returns displaced by the advancing tubular 20 may flow from the tubular string 20, through the nose 120, and the mandrel 115, and to the poppet 215. The displaced fluid may exert pressure on the second poppet face, thereby moving the poppet 215 and the stem 220 against the poppet spring 230 and toward the baffle 235 and away from the seat 210, thereby compressing the poppet spring 230 and opening a fluid path between the poppet 215 and the seat 210. The returns flow may continue through the top drive 1 and the Kelly hose and may be diverted to the rig returns system.

Figure 5:
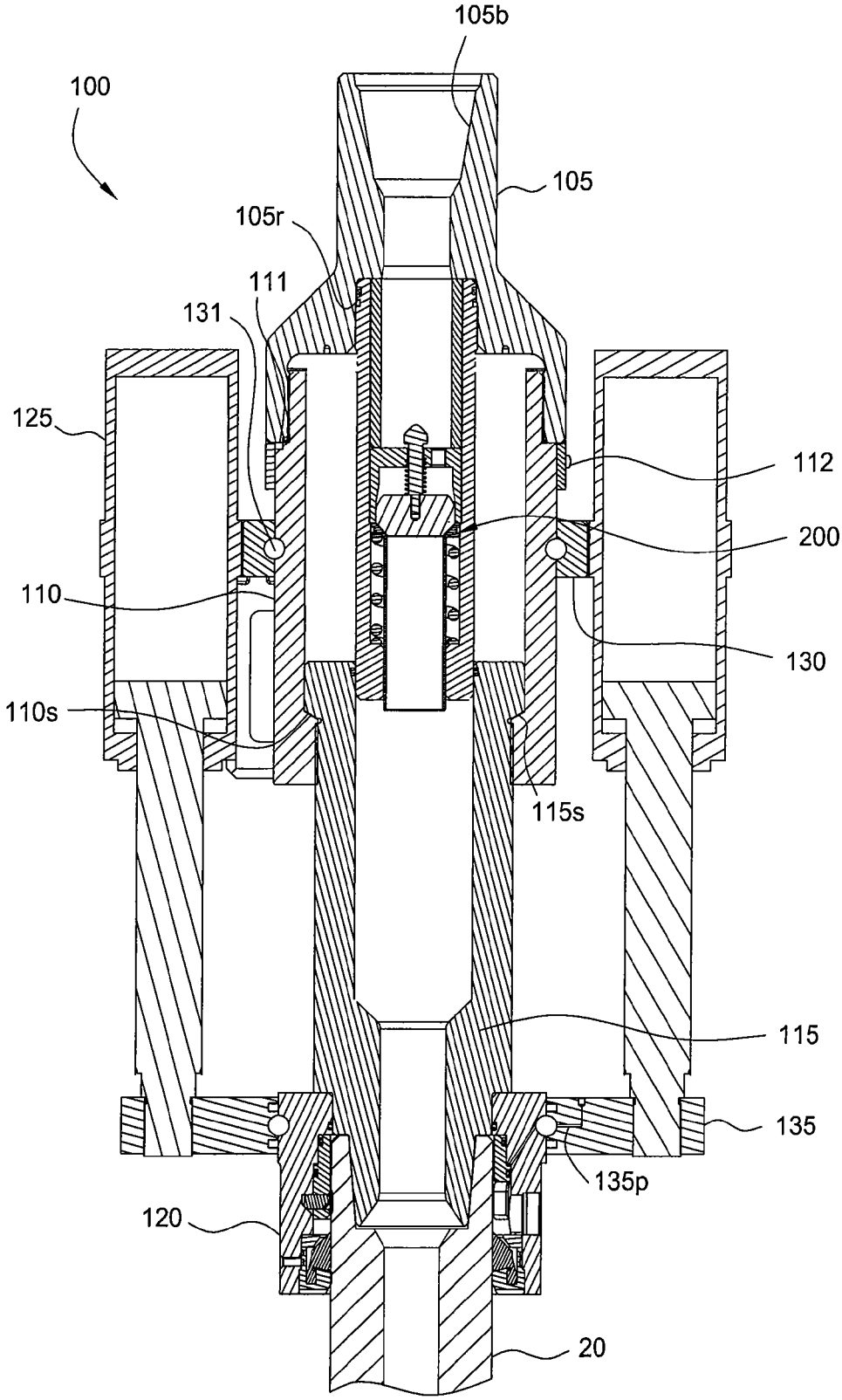
FIG. 5 is a cross section of the flowback tool in a well control position.

FIG. 5 is a cross section of the flowback tool 100 in a well control position. While the sealing capability of the seal 270 may be substantial, it may nevertheless be insufficient to handle a well control event, such as a kick or underbalance pressure situation. If/when such an event is detected, advancement of the tubular string 20 may be halted and the spider set to support the tubular string 20. Fluid pressure may be relieved from the piston 255. Fluid pressure may then be supplied (or maintained) to the PCAs 125 to lower the nose 120 until the mandrel shoulder 115*s* abuts the housing shoulder 110*s*. As discussed above, abutment of the housing and mandrel shoulders 110*s*, 115*s* may occur before the PCAs 125 bottom out, thereby preventing the PCAs from supporting weight of the tubular string 20.

Since pressure has been relieved from the piston 255, the tubular 20 may push the piston 255 toward the unlocked position via engagement with the dogs 270. The remaining stroke length of the mandrel/housing may be insufficient to completely move the piston 255 to the unlocked position. If so, then the elevator 10 may be disengaged and the top drive 1 lowered until the tubular 20 completely pushes the piston to the unlocked position, thereby radially pushing the dogs 260 into the recess 250*r* and engaging the box 20*b* with the mandrel pin 115*p*. The top drive backup tong may engage the tubular 20 and the top drive motor may then be operated to rotate the mandrel pin 115*p* relative to the box 20*b*, thereby making up the threaded connection. The seal 270 may remain engaged to the tubular 20 while shifting from the engaged position to the well control position.

With the substantial increase in sealing capability afforded by the threaded connection between the box 20*b* and the pin 115*p*, remedial action may be taken to regain pressure control over the wellbore, such as circulation of heavy weight mud or kill fluid until the annulus of the wellbore is filled with the kill fluid or circulation of the wellbore with drilling fluid until the kick subsides. Further, if necessary, a well control valve in the top drive may be closed. Once control of the wellbore is regained, advancement of the tubular string 20 may continue. The spider may be disengaged from the tubular string. The elevator may not need to be reengaged as engagement of the housing and mandrel shoulders 110*s*, 115*s* may support the weight of the tubular string 20. The tubular string 20 may then be advanced into the wellbore until another joint/stand needs to be added. Further, the tubular string 20 may be rotated while advanced.

Figure 6:
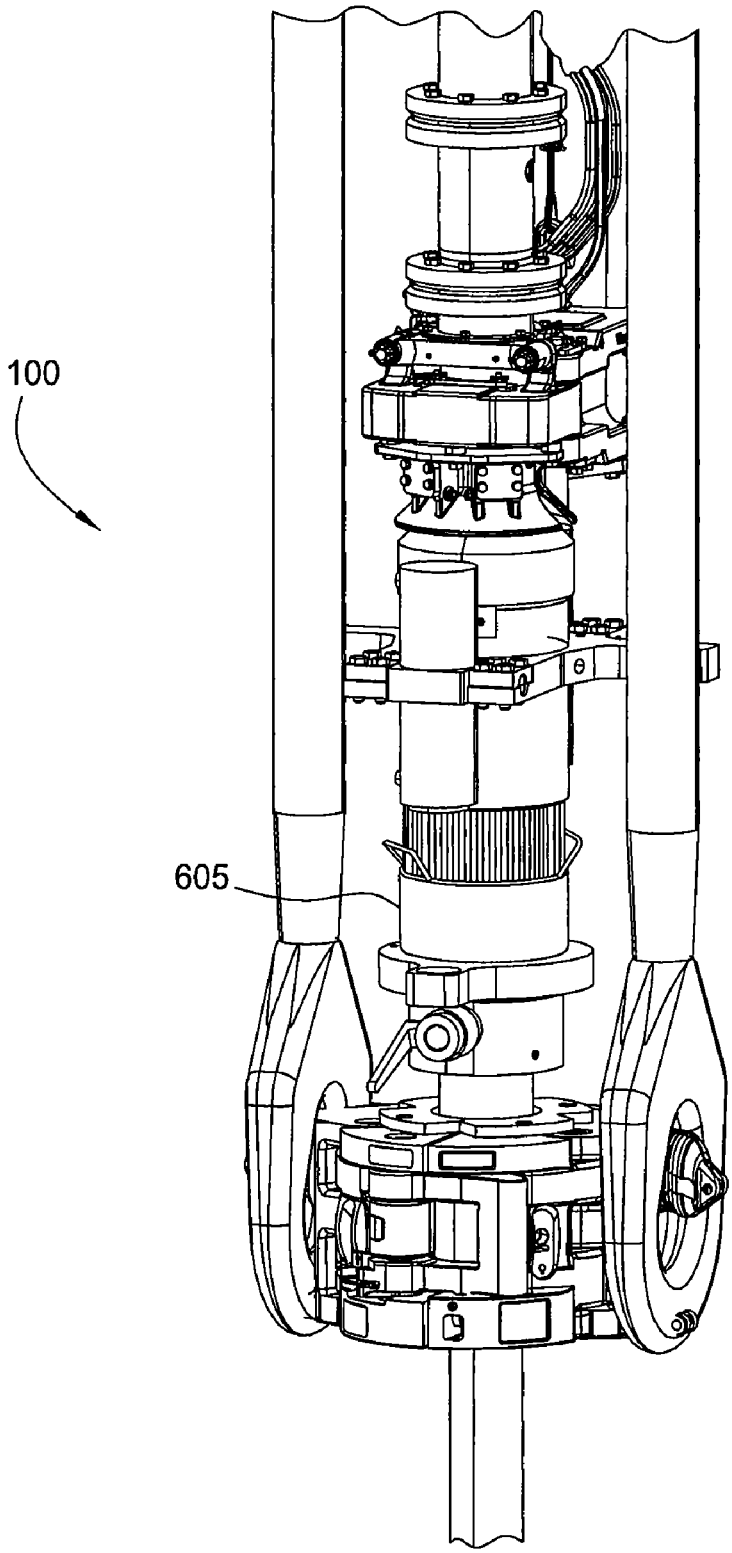
FIG. 6 illustrates a clamp connected to the flowback tool for disconnecting the flowback tool from the tubular string.
Figure 6A:
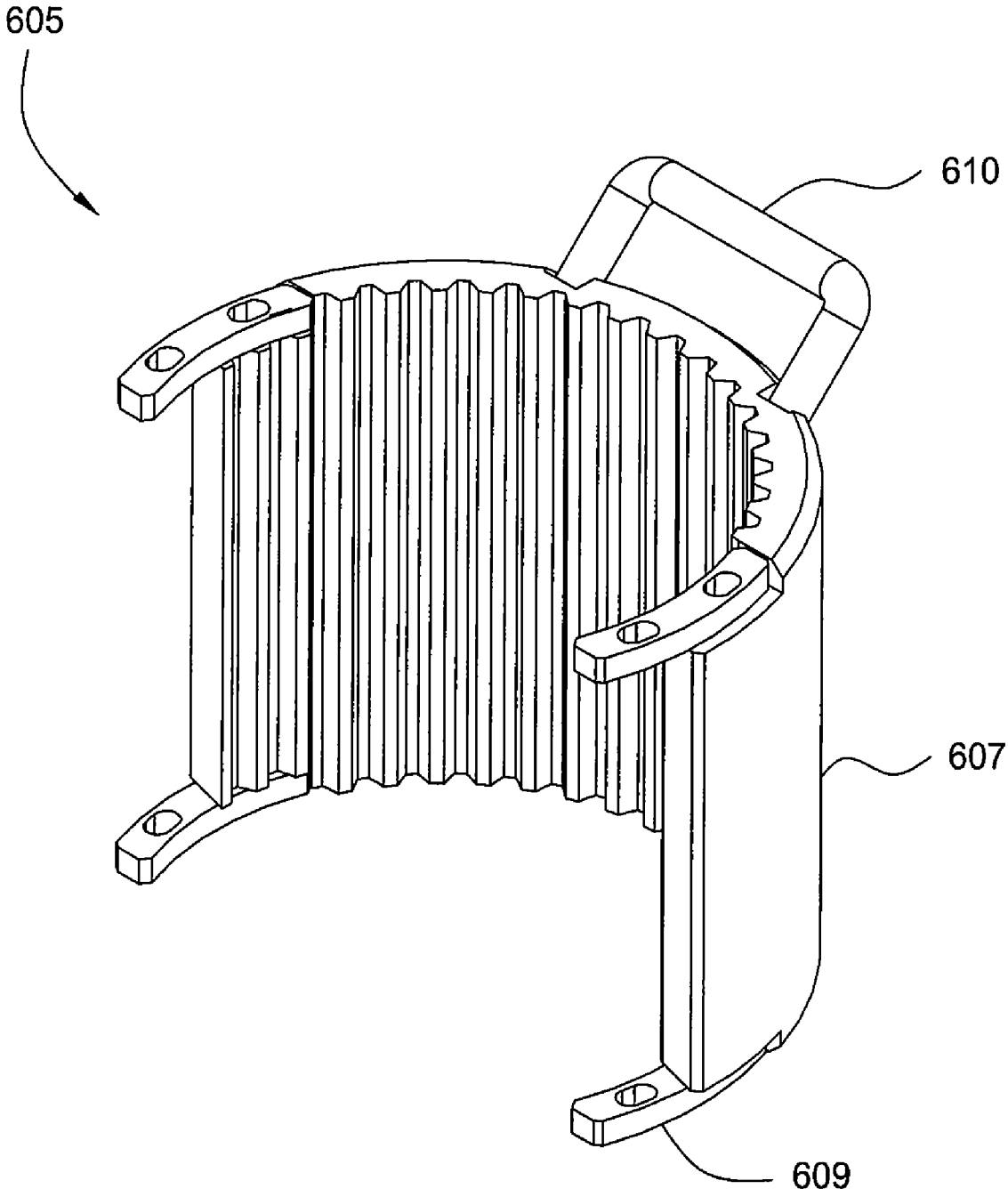
FIG. 6A illustrates a portion of the clamp.

FIG. 6 illustrates a clamp 605 connected to the flowback tool 100 for disconnecting the flowback tool 100 from the tubular string 20. FIG. 6A illustrates a portion 607 of the clamp 605. To disengage the mandrel pin 115*p* from the box 20*b* so another joint/stand may be added, the spider may be engaged with the tubular string 20. The pistons of the PCAs 125 may be removed from the second swivel 135 and retracted into the cylinders of the PCAs 125 to allow access to the mandrel 115. A clamp 605 may be assembled around the mandrel 115. The clamp may include two semi-annular segments 607. Each segment 607 may have a longitudinally splined inner surface for engaging the splined mandrel outer surface, thereby torsionally coupling the clamp to the mandrel. The segments may be retained together by retainers 609. Each retainer 609 may include holes formed therethrough for receiving fasteners, such as screws. Each segment 607 may include corresponding holes for receiving the fasteners. Each segment 607 may include a handle 610 to facilitate carrying. Each segment 607 may have a smooth outer surface for receiving jaws of the drive tong (not shown). The clamp 605 may be set on the first longitudinal end of the nose 120. A backup tong may be engaged with the tubular string 20 and a drive tong may be engaged with an outer surface of the clamp 605. The drive tong may be operated to break out the mandrel pin 215*p* from the box 20*b*. Use of the clamp 605 instead of the top drive 1 to break out the connection 115*p*, 20*b* may ensure that the connection between the cap 105 and the quill is not unintentionally loosened or broken out. Once the connection 115*p*, 20*b* is broken, normal operation of the flowback tool 100 may resume.

In another embodiment, discussed and illustrated in FIGS. 1-11 of the '892 provisional (incorporated above), an annular piston may be used instead of the PCAs to actuate the flowback tool and the flowback tool may further include a well control valve.

In another embodiment, discussed and illustrated in FIGS. 12-13 of the '892 provisional, an alternate well control valve is used.

In another embodiment, discussed and illustrated in FIGS. 14-18 of the '892 provisional, the nose may be longitudinally moved by rotating the top drive instead of using the PCAs and the mandrel may be moved by disengaging the elevator and lowering the top drive.

In another embodiment, discussed and illustrated in FIGS. 19-20 of the '892 provisional, the nose and the mandrel may be longitudinally moved by rotating the top drive instead of using the PCAs.

While the foregoing is directed to embodiments of the present invention, other and further embodiments of the invention may be devised without departing from the basic scope thereof, and the scope thereof is determined by the claims that follow.

The invention claimed is:

1. A flowback tool for running a tubular string into a wellbore, comprising:
- a tubular housing having a bore therethrough and a coupling for connection with a quill of a top drive;
- a tubular mandrel:
  - having a bore therethrough in communication with the housing bore,
  - longitudinally movable relative to the housing,
  - torsionally coupled to the housing, and
  - having a threaded coupling for being made up with a threaded coupling of the tubular string, thereby forming a threaded connection therewith;
- a nose:
  - longitudinally coupled to the mandrel,
  - operable to receive an end of the tubular string, and
  - comprising a seal operable to engage a surface of the tubular string,
- thereby providing fluid communication between a bore of the tubular string and the mandrel bore; and
- an actuator operable to move the mandrel and the nose longitudinally relative to the housing for engaging and disengaging the tubular string.

2. The flowback tool of claim 1, wherein the nose further comprises a lock fluidly operable to prevent engagement of the threaded couplings in the locked position and allow engagement of the threaded couplings in the unlocked position.

3. The flowback tool of claim 1, wherein the actuator comprises:
- a first swivel longitudinally coupled to the housing, the first swivel having arms extending radially outward therefrom, the arms for engaging bails connected to a non-rotating top drive frame, thereby torsionally coupling the first swivel to the top drive frame; and
- piston and cylinder assemblies (PCAs) having a first end longitudinally coupled to the first swivel.

4. The flowback tool of claim 3, wherein:
- the nose further comprises a piston and dogs,
- the piston is operable to radially extend the dogs, the dogs are operable to engage the end of the tubular string and prevent engagement of the threaded couplings in the extended position, and the actuator further comprises a second swivel longitudinally coupled to the nose and a second end of the PCAs, the second swivel having a port in fluid communication with the piston.

5. The flowback tool of claim 1, further comprising a mud-saver valve (MSV) operable to allow flow between the housing and the mandrel when a pressure differential (pressure in the housing minus pressure in the mandrel) is greater than or equal to a first predetermined pressure or less than a second predetermined pressure and prevent flow between the housing to the mandrel when the pressure differential is less than the first predetermined pressure and greater than or equal to the second predetermined pressure.

6. The flowback tool of claim 1, wherein the housing has a shoulder formed at an end thereof and the mandrel has a shoulder formed at an end thereof and the flowback tool is operable to support the weight of the tubular string upon engagement of the shoulders.

7. The flowback tool of claim 1, wherein the tool is configured so that the nose and the mandrel are not biased or biased away from the tubular string by fluid pressure when the seal is engaged with the tubular string.

8. The flowback tool of claim 1, wherein the tool is operable to maintain engagement of the seal with the surface while the threaded couplings are engaged and made up.

9. The flowback tool of claim 1, wherein the nose has a vent formed through a wall thereof and the vent is in fluid communication with a seal chamber defined between the seal and the mandrel bore.

10. A system for running a tubular string into the wellbore, comprising:

the top drive comprising a motor and a frame, the motor operable to rotate the quill relative to the frame, the flowback tool of claim 1 connected to the quill by a threaded connection;

an elevator longitudinally coupled to the frame, the elevator operable to engage and support the tubular string.

11. A method for running a tubular string into a wellbore, comprising:

engaging a tubular string with an elevator;

operating an actuator of a flowback tool in fluid communication with a Kelly hose, thereby:

lowering a nose and mandrel of the flowback tool to an end of the tubular string relative to a housing of the flowback tool, wherein:

the housing is longitudinally coupled to a traveling block of a drilling rig, and the mandrel is torsionally coupled to the housing and has a threaded coupling for being made up with a threaded coupling of the tubular string, thereby forming a threaded connection therewith;

engaging a seal of the nose with a surface of the tubular string, and providing fluid communication between a bore of the tubular string and the Kelly hose; and lowering the tubular string into the wellbore using the elevator.

12. The method of claim 11, further comprising pressurizing a lock of the nose, wherein the nose is lowered until the end of the tubular string engages the lock.

13. The method of claim 10, wherein the actuator maintains engagement of the end with the lock while lowering the tubular string.

14. The method of claim 11, further comprising operating the actuator, thereby raising the nose from the tubular string and disengaging the seal from the surface, wherein a mud-saver valve of the flowback tool prevents spillage of mud from the Kelly hose.

15. The method of claim 14, further comprising venting pressure from the seal.

16. The method of claim 11, further comprising:

engaging the mandrel coupling with the tubular string coupling; and operating a top drive, thereby rotating the mandrel coupling relative to the tubular string coupling and making up the threaded connection between the mandrel and the tubular string.

17. The method of claim 16, wherein the seal remains engaged to the surface while engaging the couplings and operating the top drive.

18. The method of claim 16, further comprising relieving pressure from a lock of the nose, wherein the tubular string coupling pushes the lock to a retracted position while engaging the couplings.

19. The method of claim 11, further comprising filling a joint/stand of the tubular string with drilling fluid.

20. The method of claim 11, further comprising receiving returns displaced by the lowering of the tubular string into the wellbore.

21. The method of claim 11, further comprising circulating drilling fluid through the tubular string while lowering the tubular string into the wellbore.

* * * * *

UNITED STATES PATENT AND TRADEMARK OFFICE

CERTIFICATE OF CORRECTION

PATENT NO. : 8,118,106 B2
APPLICATION NO. : 12/401802
DATED : February 21, 2012
INVENTOR(S) : Wiens et al.

It is certified that error appears in the above-identified patent and that said Letters Patent is hereby corrected as shown below:

In the Claims:

Column 10, Claim 2, Line 53, please delete "the" after in and insert --a-- therefor;

Column 10, Claim 2, Line 54, please delete "the" after in and insert --an-- therefor;

Column 11, Claim 5, Line 9, please insert --:-- after to;

Column 11, Claim 5, Line 13, please insert --,-- after pressure;

Column 11, Claim 6, Line 17, please insert --:-- after wherein;

Column 11, Claim 6, Line 18, please insert --,-- after thereof;

Column 11, Claim 6, Line 18, please delete "and";

Column 11, Claim 6, Line 19, please insert --,-- after thereof;

Column 11, Claim 6, Line 20, please delete "the"; (1st occurrence)

Column 11, Claim 9, Line 29, please insert --:-- after wherein;

Column 11, Claim 9, Line 30, please insert --,-- after thereof;

Column 11, Claim 11, Line 43, please delete "a" and insert --the-- therefor;

Column 12, Claim 13, Line 16, please delete "10" and insert --12-- therefor.

Signed and Sealed this
Twenty-eighth Day of August, 2012

David J. Kappos

David J. Kappos
*Director of the United States Patent and Trademark Office*